US008979975B2

(12) United States Patent
Kim et al.

(10) Patent No.: US 8,979,975 B2
(45) **Date of Patent: *Mar. 17, 2015**

(54) METHOD OF PRODUCING LOW OXYGEN-CONTENT MOLYBDENUM POWDER BY REDUCING MOLYBDENUM TRIOXIDE

(71) Applicant: Korea Institute of Geoscience and Mineral Resources, Daejeon (KR)

(72) Inventors: Hyung-Seok Kim, Daejeon (KR); Jung-Min Oh, Daejeon (KR); Chang-Youl Suh, Daejeon (KR); Back-Kyu Lee, Daejeon (KR); Jae-Won Lim, Daejeon (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/079,401

(22) Filed: Nov. 13, 2013

(65) Prior Publication Data

US 2014/0144291 A1 May 29, 2014

(30) Foreign Application Priority Data

Nov. 29, 2012 (KR) ..... 10-2012-0137251

(51) Int. Cl.
*B22F 9/20* (2006.01)
*B22F 9/22* (2006.01)

(52) U.S. Cl.
CPC ... *B22F 9/20* (2013.01); *B22F 9/22* (2013.01); *B22F 2203/11* (2013.01); *B22F 2999/00* (2013.01)
USPC ..... 75/369; 75/623

(58) Field of Classification Search
None
See application file for complete search history.

(56) References Cited

U.S. PATENT DOCUMENTS 2,454,322 A 11/1948 Iredell et al.
3,027,331 A 3/1962 Schrewelius
(Continued)

FOREIGN PATENT DOCUMENTS

EP 2 055 412 A2 5/2009
JP 64-061393 A 3/1989
(Continued)

OTHER PUBLICATIONS

Sohn, et al., "Reduction Behavior of $MoO_3$ to $MoO_2$ by $Ar+H_2$ Gas Mixture," Journal of Korean Institute of Resources Recycling, vol. 20, No. 4, 2011, pp. 71-77.
(Continued)

*Primary Examiner* — George Wyszomierski
(74) *Attorney, Agent, or Firm* — Christie, Parker & Hale, LLP

(57) ABSTRACT

Disclosed is a method of producing low oxygen-content molybdenum powders by reducing molybdenum trioxide, which includes charging a first reducing agent and the molybdenum trioxide, which are in the direct contact with each other on a micro-sieve on an upper portion of a bracket in a body, charging a second reducing agent in the bracket under the micro-sieve, coupling the body with a cover to close the body, and performing a reduction reaction by raising an internal temperature of the body by performing the first reduction reaction due to direct contact between the first reducing agent and the molybdenum trioxide, and performing the second reduction reaction due to evaporation of the second reducing agent. The first and second reduction reactions are performed at a temperature in a range of 550° C. to 650° C., and a temperature in a range of 1000° C. to 1200° C., respectively.

5 Claims, 5 Drawing Sheets

(56) References Cited

U.S. PATENT DOCUMENTS

| | | | | |
|---|---|---|---|---|
| 4,491,560 | A * | 1/1985 | Fujii et al. | 420/429 |
| 7,192,467 | B2 | 3/2007 | Khan et al. | |
| 7,276,102 | B2 | 10/2007 | Johnson, Jr. et al. | |
| 7,354,472 | B2 * | 4/2008 | Shekhter et al. | 75/351 |
| 2004/0112176 | A1 | 6/2004 | Khan et al. | |
| 2005/0279187 | A1 | 12/2005 | Shekhter et al. | |
| 2011/0223054 | A1 * | 9/2011 | Gries | 420/429 |
| 2014/0151944 | A1 | 6/2014 | Kim et al. | |

FOREIGN PATENT DOCUMENTS

| | | | |
|---|---|---|---|
| JP | 2002-544375 | | 12/2002 |
| JP | 2004-052003 | | 2/2004 |
| JP | 2005-133197 | | 5/2005 |
| JP | 2005-314715 | | 11/2005 |
| JP | 2008-503654 | A | 2/2006 |
| JP | 2007-512438 | | 5/2007 |
| JP | 2007-512438 | A | 5/2007 |
| JP | 2007-154231 | | 6/2007 |
| JP | 2008-518095 | | 5/2008 |
| JP | 5465348 | B1 | 4/2014 |
| KR | 10-0579408 | | 5/2006 |
| KR | 10-0626437 | | 9/2006 |
| KR | 10-1135160 | | 4/2012 |
| WO | WO 2011/004887 | A1 | 1/2011 |

OTHER PUBLICATIONS

Nartowski, et al., "Solid state metathesis synthesis of metal silicides; reactions of calcium and magnesium silicide with metal oxides," Polyhedron No. 21, 2002, pp. 187-191.

Japanese Notice of Allowance for Application No. 2013-016671, dated Oct. 21, 2014, 3 pages.

* cited by examiner

METHOD OF PRODUCING LOW OXYGEN-CONTENT MOLYBDENUM POWDER BY REDUCING MOLYBDENUM TRIOXIDE

CROSS-REFERENCE TO RELATED APPLICATION

This application claims the benefit under 35 U.S.C. §119 of Korean Patent Application No. 10-2012-0137251 filed on Nov. 29, 2012 in the Korean Intellectual Property Office, the entirety of which disclosure is incorporated herein by reference.

BACKGROUND OF THE INVENTION

1) Field of the Invention

The present invention relates to a method of producing low oxygen-content molybdenum (Mo) powders, and more particularly to a method producing low oxygen-content Mo powders by reducing molybdenum trioxide ($MoO_3$) using calcium (Ca).

2) Background of Related Art

Molybdenum (Mo) is one of transition metals on the Periodic Table, and pure Mo represents a silver-white color and has a significant stiffness property. In addition, the pure Mo has remarkably high melting point (2896 K) and boiling point (4912 K).

Since molybdenum (Mo) represents superior physical, chemical, and mechanical characteristics, molybdenum (Mo) is used in various industrial fields. In particular, Mo is spotlighted as a high-temperature source material. In addition, since molybdenum (Mo) makes various effects even if only a small amount of molybdenum (Mo) is contained, molybdenum (Mo) has been used as a main source material of special steel.

However, since molybdenum (Mo) is metal representing a high melting point as described above, the molding and the processing for molybdenum (Mo) is difficult. Accordingly, a related product must be manufactured through a powder metallurgy scheme after forming molybdenum (Mo) powders.

According to the related art, the most general scheme to obtain molybdenum (Mo) is to perform two-step reduction processes with respect to molybdenum trioxide ($MoO_3$) at a hydrogen atmosphere.

Meanwhile, another scheme is to obtain metal molybdenum (Mo) through the mixture of metal representing oxygen reduction reaction superior to that of molybdenum (Mo).

According to the related art subject to the reduction process at the hydrogen atmosphere, the high content of oxygen remains in the reduced molybdenum (Mo) powders. Since at least one metal is mixed for use when performing a reduction reaction using metal representing oxygen reduction reaction superior to that of molybdenum (Mo), contamination may be caused with high probability due to the metal, and the retrieving of molybdenum (Mo) is difficult.

Mainly, the reduction to metal molybdenum (Mo) from $MoO_3$ is performed by removing oxygen. Accordingly, it is more advantageous that the lower content of oxygen is contained in the finally reduced metal (Mo).

In particular, since high-melting point metal including molybdenum (Mo) represents high affinity with oxygen and gas impurities, the high-melting metal may be easily contaminated by oxygen and gas impurities. In this case, the excessively high content of oxygen contained in the metal causes the fragility.

Further, in the case of powders, as the content of oxygen is lowered, the density of powers may be enhanced when the powders are sintered. Accordingly, the molybdenum (Mo) powders having the low content of oxygen have been demanded.

In addition, as the particle size of the powders of the metal molybdenum (Mo) is reduced, the reaction activity may be increased. Accordingly, conventionally, there is a limitation in obtaining low oxygen-content Mo powders having a sufficiently small size.

Following cited references are provided as related arts.

Paper 1: "The reduction behavior from $MoO_3$ to $MoO_2$ by the mixed gas of Ar+H2" (Journal of the Korean Institute of Resources Recycling No. 20, Vol. 4, pp. 71-77, 2011).

Paper 2: "Solid state metathesis synthesis of metal silicides; reactions of calcium and magnesium silicide with metal oxides" (Polyhedron No. 21, pp. 187-191, 2002).

SUMMARY OF THE INVENTION

An object of the present invention is to provide a method capable of simply obtaining metal molybdenum (Mo) powders in the phase of fine powders, which have the particle size of 5 μm or less and the low content of oxygen, from molybdenum trioxide ($MoO_3$) powders.

The objects of the present invention are not limited to the above-mentioned objects, and other objects will be clearly understood by those skilled in the art.

In order to accomplish the object, there is provided a method of producing low oxygen-content molybdenum powders by reducing molybdenum trioxide. The method includes charging a first reducing agent and the molybdenum trioxide on a micro-sieve, which is located on an upper portion of a bracket installed in a body, while the first reducing agent and the molybdenum trioxide are directly making contact with each other, charging a second reducing agent in the bracket under the micro-sieve, coupling the body with a cover to close the body, and performing a reduction reaction by raising an internal temperature of the body.

Preferably, the first reducing agent and the second reducing agent comprise calcium powders, and the calcium powders constituting the first reducing agent have a particle size different from a particle size constituting the second reducing agent.

In addition, preferably, the first reducing agent is charged in a content of 25 parts by weight to 75 parts by weight based on 100 parts by weight of molybdenum trioxide powders, and the second reducing agent is charged in a content of 200 parts by weight to 300 parts by weight based on 100 parts by weight of the molybdenum trioxide powders.

Further, the performing of the reduction reaction by raising the internal temperature of the body includes performing a first reduction reaction due to direct contact between the first reducing agent and the molybdenum trioxide, and performing a second reduction reaction due to evaporation of the second reducing agent.

In this case, preferably, the first reduction reaction is performed at a temperature in a range of 550° C. to 650° C., and the second reduction reaction is performed at a temperature in a range of 1000° C. to 1200° C.

Further, preferably, a time to raise a temperature to a reduction temperature for the first and second reduction reactions is in a range of 30 minutes to two hours, and a time to maintain the first and second reduction reactions is in a range of one hour to three hours.

Meanwhile, according to the method of producing the low oxygen-content molybdenum powders by reducing molybdenum trioxide of the present invention, metal molybdenum powders having the oxygen content of 3,000 ppm can be acquired.

Details of other embodiments are included in the detailed description and the accompanying drawings.

The advantages, the features, and schemes of achieving the advantages and features of the present invention will be apparently comprehended by those skilled in the art based on the embodiments, which are detailed later in detail, together with accompanying drawings.

The present invention is not limited to the following embodiments but includes various applications and modifications. The embodiments will make the disclosure of the present invention complete, and allow those skilled in the art to completely comprehend the scope of the present invention. The present invention is only defined within the scope of accompanying claims.

In the following description, the same reference numerals will be assigned to the same reference elements, and the description of the sizes and the positions of components constituting the present invention, and the coupling relation between the components may be exaggerated for clarity.

As described above, according to the present invention, metal molybdenum (Mo) powders, which have the particle size of 5 μm or less, and the content of oxygen of 3,000 ppm or less, can be obtained.

DETAILED DESCRIPTION OF THE INVENTION

Hereinafter, embodiments of the present invention will be described in detail with reference to accompanying drawings.

First, reduction or deoxidation reactions employed in the present invention are actually the same as reactions occurring in both of the reduction to molybdenum dioxide ($MoO_2$) from molybdenum trioxide ($MoO_3$) and the reduction to metal molybdenum (Mo) from the $MoO_2$.

Figure 1:
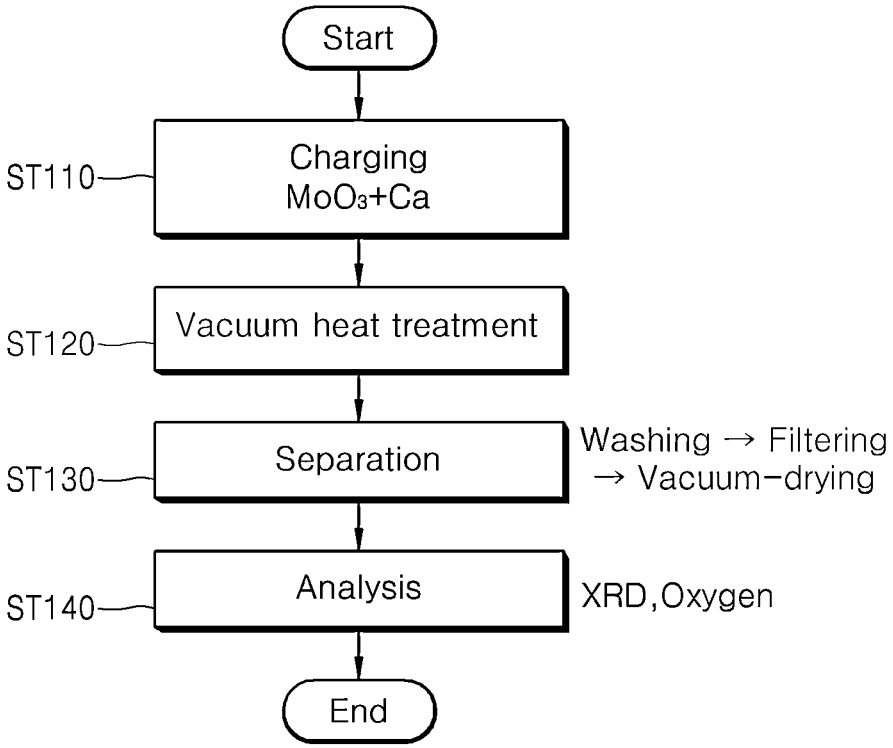
FIG. 1 is a flowchart showing the schematic sequence in a method of producing the low oxygen-content Mo powders by reducing $MoO_3$ according to an example embodiment of the present invention.

FIG. 1 is a flowchart showing the schematic sequence in the method of producing the low oxygen-content Mo powders by reducing $MoO_3$ according to an example embodiment of the present invention.

As recognized from FIG. 1, the method of producing the low oxygen-content Mo powders by reducing $MoO_3$ according to the present invention includes a step (step ST110) of charging $MoO_3$ powders and calcium (Ca) powders, a vacuum heat treatment step (step ST120), a separation step (step ST130), and an analysis step (step ST140).

The separation step (step ST130) may further include a cleaning step, a filtering step, and a vacuum-drying step.

According to the step (step ST110) of charging $MoO_3$ powders and Ca powders, a bracket is installed at a lower central portion of a container body, and filled therein with large calcium (Ca) granules.

In this case, the calcium (Ca) serves as a deoxidizing agent used to reduce $MoO_3$. The calcium (Ca) represents a high oxygen-affinity with $MoO_3$.

In addition, the micro-sieve is placed on the bracket. The micro-sieve is provided on the top surface thereof with the small calcium granules and the $MoO_3$ powder uniformly mixed together while directly making contact with each other. Thereafter, the cover is placed on the container body, and the container body and the cover are sealed together by using the joint.

In this case, preferably, the particle size of the large calcium granules is in the range of about 2 mm to 5 mm, the particle size of the small calcium granules is in the range of about 300 μm to about 500 μm, and the particle size of the $MoO_3$ powders is 150 μm or less.

In addition, the large calcium granules are preferably charged in the range of 200 parts by weight to 300 parts by weight based on 100 parts by weight of the $MoO_3$ powders when taking into consideration an amount of the large calcium granules required in the reduction of $MoO_3$ according to the present invention. In addition, preferably, the small calcium granules are charged in the range of 25 parts by weight to 75 parts by weight based on 100 parts by weight of the $MoO_3$ powders.

If the large calcium granules are charged in the content of less than 200 parts by weight based on 100 parts by weight of the $MoO_3$, an amount of evaporated calcium is insufficient, so that the reduction by using calcium does not reach a desired level.

On the contrary, if the large calcium granules are charged in the content of more than 300 parts by weight based on 100 parts by weight of the $MoO_3$, an amount of calcium, which does not contribute to the reduction reaction, but remains, may be increased.

If the small calcium granules are charged in the content of less than 25 parts by weight based on 100 parts by weight of the $MoO_3$, the direct reduction by using calcium is insufficiently achieved, so that the reduction by using the calcium does not reach a desired level.

On the contrary, if the small calcium granules are inserted in the content of more than 75 parts by weight based on 100 parts by weight of the $MoO_3$, an amount of the small calcium granules remaining after the reduction reaction has been finished is increased, so that the small calcium granules may not be smoothly separated from the $MoO_3$ powders.

According to the present invention, 25 g of the large calcium granules was charged into the bracket installed at the lower portion of the container body.

An amount of the charged $MoO_3$ was 10 g, and an amount of the charged small calcium granules was 5 g.

In this case, the small calcium granules directly making contact with the $MoO_3$ were charged after the large calcium granules have been ground to the size of about 300 μm to 500 μm.

Next, according to the vacuum heat treatment step (step ST120), air is exhausted from the inner portions of the container body and the cover, which have been sealed, by using a vacuum pump, and first and second reduction steps are performed as follows.

First Reduction Step

The internal temperature of the container body is raised to the temperature in the range of 550 to 650 corresponding to the first reduction temperature of the $MoO_3$ through the vacuum heat treatment step, and the raised temperature is maintained.

The time of about 30 minutes to about 2 hours may be required to raise the internal temperature. Most preferably, the time of about one hour is required.

If the time spent to raise the internal temperature is less than 30 minutes, the large calcium granules may be coagulated with each other or the small calcium granules may be coagulated with each other. If the time spent to raise the internal temperature exceeds two hours, only both of the time spent for the reduction reaction and the applied energy are raised.

If the first reduction temperature is maintained at the temperature of less than 550, the reduction from the $MoO_3$ powders to molybdenum dioxide ($MoO_2$) is insufficient. If the first reduction temperature is maintained at the temperature of more than 650, the $MoO_3$ is undesirably sublimated.

Most preferably, the first reduction temperature is 600 in the vacuum heat treatment step (step ST120).

In addition, the time to maintain the first reduction temperature is preferably in the range of one hour to three hours in the vacuum heat treatment step (step ST120). More particularly, the time to maintain the first reduction temperature is about two hours in the vacuum heat treatment step (step ST120).

If the time to maintain the first reduction temperature is less than one hour, the reduction from the $MoO_3$ powders to the $MoO_2$ powders is insufficiently performed. If the time to maintain the first reduction temperature is more than three hours, the time is meaningless time since the reduction from the $MoO_3$ powders to the $MoO_2$ powders has been finished.

Therefore, the time to maintain the first reduction temperature is most preferably about two hours.

In this case, heat is applied to the small calcium granules and the $MoO_3$ powders, which are placed on the micro-sieve spread over the upper portion of the bracket in the container body, at the first reduction temperature, and the small calcium granules directly making contact with the $MoO_3$ powders make a reduction reaction resulting from the direct contact with the $MoO_3$ powders by the heat.

In this case, since the large calcium granules filled in the bracket provided in the container body have the particle size greater than that of the small calcium granules, the calcium is not evaporated.

Second Reduction Step

After the first reduction step maintained at the first reduction temperature for 2 hours has been finished, the temperature is raised to the temperature of 1000 to 2000 corresponding to the second reduction temperature, and maintained at the second reduction temperature.

The time spent to raise the temperature may be in the range of 30 minutes to two hours. Most preferably, the time spent to raise the temperature may be about one hour.

If the time to raise the temperature is less than 30 minutes, the reduced $MoO_2$ powders may be coagulated with each other. If the time to raise the temperature is more than two hours, the time spent for the reduction and the deoxidization, and the applied energy are raised.

If the second reduction temperature is maintained at the temperature of less than 1000, the reduction from the $MoO_2$ powders to metal molybdenum (Mo) is insufficient. If the second reduction temperature is maintained at the temperature of more than 1200, the second reduction temperature does not contribute to the reduction to the metal molybdenum (Mo), but only both of the spent time and the applied energy are raised, which are not undesirable.

The most preferable second reduction temperature is 1100 in the second reduction step of the vacuum heat treatment step (step ST120).

In addition, the preferable time to maintain the second reduction temperature is in the range of one hour to three hours in the vacuum heat treatment step (step ST120). The most preferable time to maintain the second reduction temperature is about two hours.

If the time to maintain the second reduction temperature is less than one hour, the reduction from the $MoO_2$ powders to metal Mo powders is insufficiently performed. If the time to maintain the second reduction temperature is more than three hours, the time to maintain the second reduction temperature is meaningless time since the reduction from the $MoO_2$ powders to the metal Mo powders has been finished.

Therefore, the most preferable time to maintain the second reduction temperature is about two hours.

In this case, the large calcium granules filled in the bracket of the container body are evaporated at the second reduction temperature. The evaporated calcium vapor passes through the holes of the micro-sieve 130 spread over the upper portion of the bracket and then passes through the gap between the $MoO_2$ powders reduced from the $MoO_3$.

Therefore, the calcium vapor resulting from the evaporation of the large calcium granules reacts with $MoO_2$ powders, and the reduction reaction to the metal Mo powders is finally made. Thereafter, the metal Mo powders obtained through the finished reduction reaction are deoxidized by the calcium vapor to produce the low oxygen-content Mo powders.

The reaction formula between the metal Mo powders and the calcium vapor are as follows.

Ca+O(contained in molybdenum powders)=CaO [Reaction Formula]

In other words, in the second reduction step, the secondary reduction is performed through a non-contact scheme using calcium vapor, thereby producing the low oxygen-content Mo powders.

After the second reduction step has been finished, a furnace cooling process is performed under vacuum.

Thereafter, according to the separation step (step ST130), after the vacuum heat treatment step (step ST120) has been performed for about two hours, the cover of the production apparatus, which is sufficiently cooled, is open and the reduced Mo powders and the remaining calcium are drawn from the container body and separated from each other.

In this case, impurities may remain on the surface of the deoxidized Mo powders. In detail, CaO produced during the deoxidization process may be attached to the surface of the Mo powders.

The present separation step (step ST130) may further include a washing process to clean and/or pickle the Mo powders and calcium, which are separated from each other, a filtering process, and a drying process for Mo powders and Ca. The CaO is removed through the present separation step (step ST130), and the metal Mo powders can be finally retrieved.

The pickling in the washing process is performed by using a pickling solution representing the ratio of $H_2O$:HCl=10:1. The cleaning and the pickling in the washing process may be selectively performed through at least one scheme. Preferably, the cleaning and the pickling are repeated several times.

After the washing process has been finished, only the metal Mo powders may be obtained by filtering the metal Mo powders and other impurities produced by the deoxidizing agent.

In other words, a small amount of impurities such as CaO remaining on the surface of the reduced metal Mo powders are sufficiently removed through the washing process.

Although the separated metal Mo powders may be dried through various schemes, the separated Mo powders may be preferably dried through a vacuum drying scheme in order to obtain the metal Mo powders containing the low content of oxygen.

The vacuum drying process may be performed for about two hours at the temperature of about 60.

Finally, in the analysis step (step ST140), an SEM analysis is performed with respect to metal Mo powders, which has been subject to the vacuum drying process, in order to measure the average particle size and the shape of the Mo powders.

Figure 4:
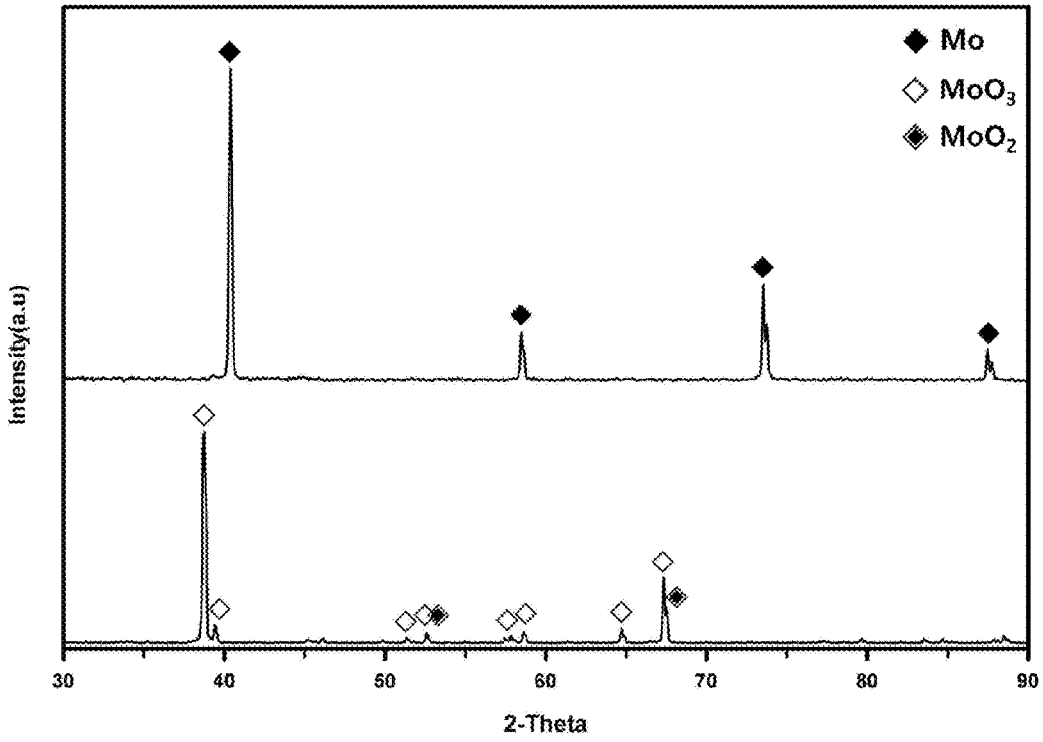
FIG. 4 is a graph showing XRD patterns of $MoO_3$ serving as a source material and metal Mo powders which have been subject to the reduction reaction through production method according to the present invention.

FIG. 4 shows the results of the SEM analysis.

In addition, in order to determine the composition of $MoO_3$ and the final Mo powders, an XRD analysis (performed by Rigaku, RTP 300 RC) is performed, and the content of oxygen in the Mo powders is measured by a gas analyzer (LECO TCH-600).

Figure 5:
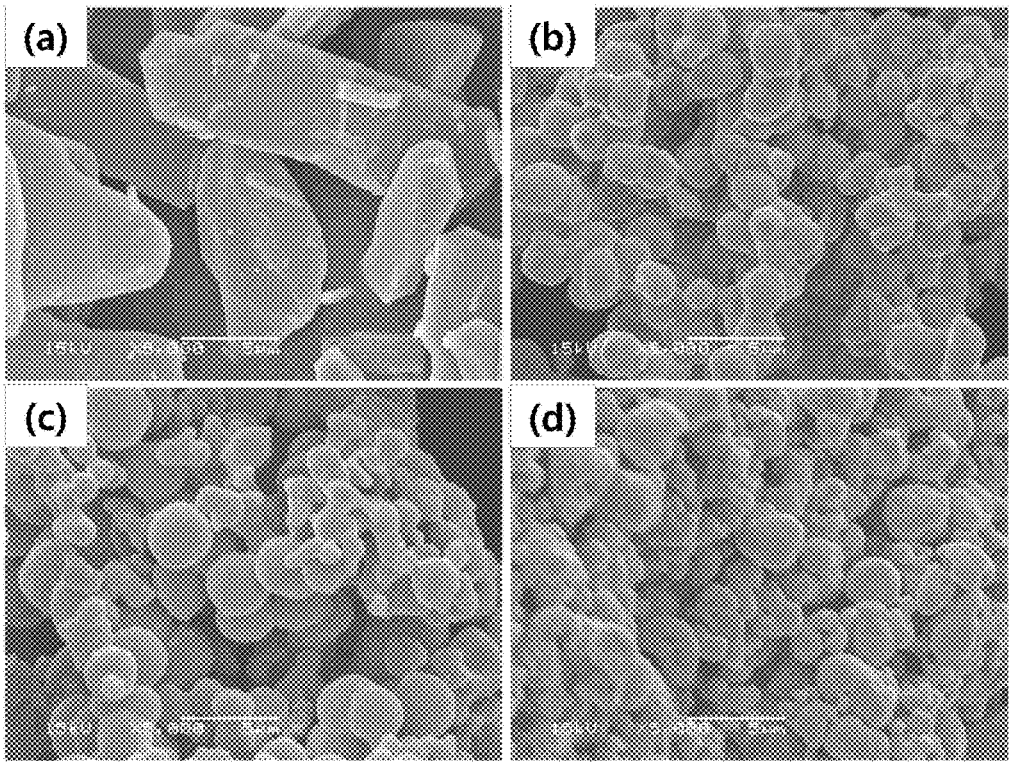
FIGS. 5(*a*) to 5(*d*) show SEM photographs, in which FIG. 5(*a*) shows the shape of $MoO_3$ powders serving as the source material, FIG. 5(*b*) shows the shape of metal Mo powders acquired according to the present invention, FIG. 5(*c*) shows the shape of metal Mo powders acquired through a hydrogen reductions scheme by using the same source material, FIG. 5(*d*) shows the shape of commercial Mo powders (Kojundo Chemical Laboratory Co., Ltd., Japan, 99.99% of purity).

The analysis results are shown in FIG. 5 and table 1.

Figure 2:
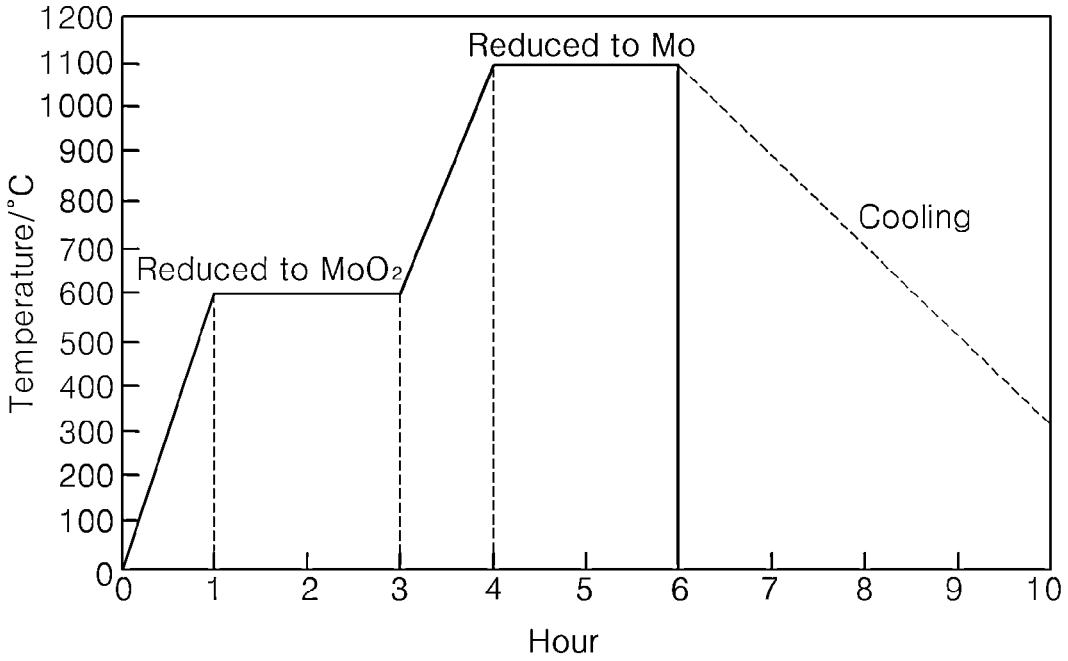
FIG. 2 is a graph showing the process time and the temperature condition in the method of producing the low oxygen-content Mo powders by reducing $MoO_3$ according to the example embodiment of the present invention.

FIG. 2 is a graph showing the process time and the temperature condition when producing the low oxygen-content Mo powders by reducing $MoO_3$ according to the example embodiment of the present invention.

As recognized from FIG. 2, according to the example embodiment of the present invention, the producing of the low oxygen-content Mo powders by reducing $MoO_3$ include the reduction process to $MoO_2$ (first reduction step) and the reduction process to Mo (second reduction step).

The first reduction step is performed for two hours at the first reduction temperature of 600 and the second reduction step is performed for two hours at the second reduction temperature of 1100.

The first reduction temperature and the second reduction temperature are raised right before the first reduction step and the second reduction step, respectively.

After the second reduction step has been finished, a cooling process is performed in a vacuum heat treatment furnace.

Figure 3:
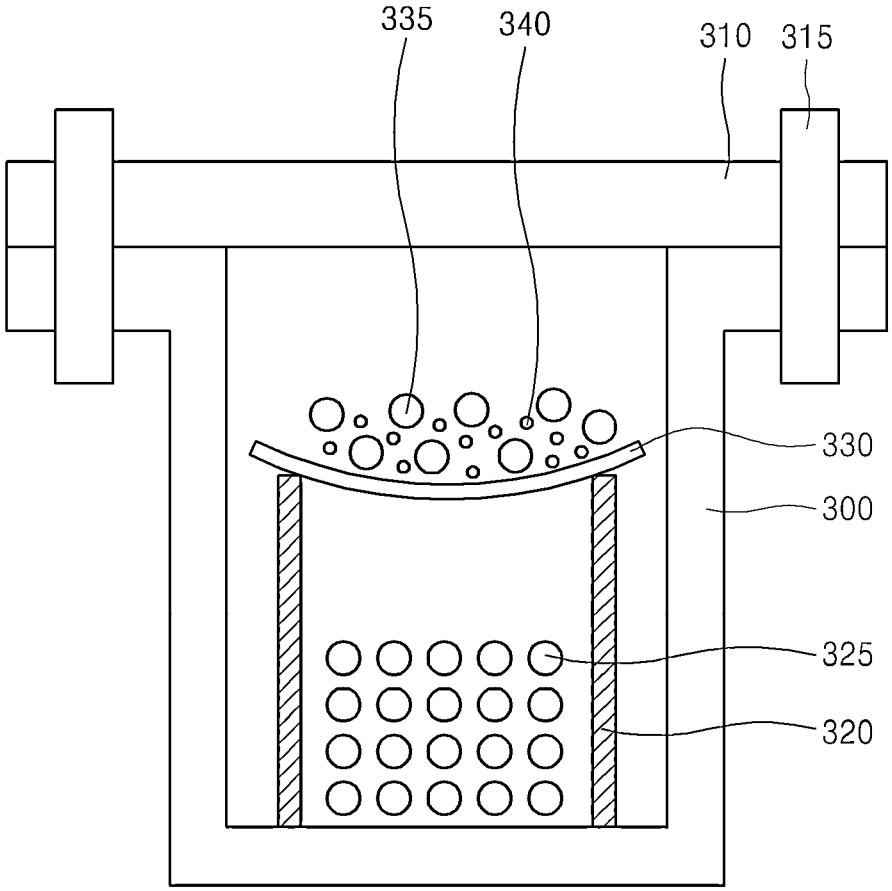
FIG. 3 is a sectional view schematically showing an apparatus can be used in the method of producing low oxygen content-Mo powders by reducing $MoO_3$ according to an exemplary embodiment of the present invention.

FIG. 3 is a sectional view schematically showing an apparatus which can be used in the method of producing low oxygen content-molybdenum (Mo) powders by reducing $MoO_3$ according to an exemplary embodiment of the present invention.

Referring to FIG. 3, the apparatus for producing low oxygen content-Mo powders by reducing $MoO_3$ (hereinafter referred to as "production apparatus") according to one embodiment of the present invention may include a container body 300, a cover 310, and a joint 315.

Preferably, the container body 300 and the cover 310 are formed of metal. More preferably, the container body 300 and the cover 310 are formed at the thickness to endure a pressure applied to the production apparatus during the operation thereof.

Preferably, the container body 300 is formed in a hollow structure having a U shape provided therein with an empty space, has an open upper portion, and has a coupling surface, which is substantially matched with the cover 310, at the edge of the upper portion of the container body 300.

The cover 310 is located at the upper portion of the container body 300.

The edge of the container body 300 is preferably matched with the edge of the cover 310. The container body 300 may be provided at upper peripheral portions thereof with joints 315 (expressed as protrusion parts at the right and left sides of FIG. 1) for the coupling with the cover 310.

The joints 315 are preferably provided in the form of bolts to seal the gap between the container body 300 and the cover 310. Alternatively, the joints 315 may be preferably provided in the form of clamps so that the container body 300 can be easily separated from the cover 310 after producing low oxygen content-Mo powders.

More preferably, a seal may be interposed between the container body 300 and the cover 310 to additionally seal the contact surface between the container body 300 and the cover 310.

Preferably, the seal may include a material to endure a high temperature and a high pressure. For example, the seal may include a metallic material.

The apparatus for producing low oxygen-content Mo powders by reducing $MoO_3$ according to one embodiment of the present invention may further include a bracket 320 and a micro-sieve 330.

Preferably, the bracket 320 is positioned at the central portion of the floor of the container body 300. Most preferably, the bracket 320 is formed in the shape of a cylinder having open upper and lower portions and closed lateral sides. In addition, a heater may be additionally installed in an inner lower portion of the bracket 320.

Alternatively, the bracket 320 may be provided in the form of a U-shaped container having a closed lower portion.

In addition, the bracket 320 may be provided in the form of a tripod.

The bracket 220 is filled therein with large calcium granules (particles in the shape of granules) 325.

Preferably, the particle size of the large calcium granules 325 is in the range of 2 mm to 5 mm.

The micro-sieve 330 is installed at the upper portion of the bracket 320.

The micro-sieve 330 may be provided on the top surface thereof with small calcium granules 335, which have a particle size significantly smaller than that of the large calcium granules 325, and $MoO_3$ powders 340.

Most preferably, the small calcium granules 335 and the $MoO_3$ powders 340 are charged while making contact with each other.

The small calcium granules 335 serve as a reducing agent, and include a product prepared with the purity of 99.5% by JUNSEI Co. (Japan). The $MoO_3$ powders 340 include a product prepared with the purity of 99.95% by LTS Chemical Inc. (USA).

Meanwhile, the particle size of the small calcium granules 335 is in the range of about 300 μm to about 500 μm. The $MoO_3$ powders 340 are preferably ground in size of 150 μm.

Preferably, the holes of the micro-sieve 330 have sizes corresponding to the extent that the small calcium granules 335, especially, the $MoO_3$ powders 340 are not dropped down onto the large calcium granules 325, which have been located under the micro-sieve 330, through the micro-sieve 330.

If the holes of the micro-sieve 330 are clogged with the small calcium granules 335 or the $MoO_3$ powders 340, the large calcium granules 325 provided under the container body 300 are prevented from being evaporated and the smooth movement of the evaporated calcium vapor to the upper portion of the container body 300 can be prevented.

More preferably, the small calcium granules 335 and the $MoO_3$ powders 340 are uniformly mixed with each other, so that the small calcium granules 335 may more easily make the reduction to $MoO_3$ powders 340 during the reduction reaction thereof.

If the bracket 320 is provided in a cylindrical shape, a tray (not shown) may be additionally installed to receive large calcium granules 325.

In this case, the contamination, which caused by coagulated calcium attached to the floor of the container body 100 after finishing the reaction related to the evaporation and the melting of the large calcium granules 325, can be actively prevented.

FIG. 4 is a graph showing an XRD pattern of $MoO_3$ serving as a source material and metal Mo powders which have been subject to the reduction reaction by the production apparatus according to the present invention.

The XRD pattern of $MoO_3$ serving as a source material is shown in the lower portion of FIG. 4, and the XRD pattern of the metal Mo powders acquired by the production apparatus according to the present invention is shown in the upper portion of FIG. 4.

As recognized from FIG. 4, although most of the source material includes $MoO_3$, and the source material partially includes $MoO_2$.

Further, as recognized from FIG. 4, the XRD pattern for a test sample of the metal Mo powders, which are acquired through the second reduction step by the production apparatus according to the present invention, shows that only a peak value of the metal Mo is detected, which represents the perfect acquisition of the metal Mo powders.

In other words, the metal Mo powders can be produced through the second reduction step by using calcium (Ca).

FIGS. 5(*a*) to 5(*d*) show SEM photographs. FIG. 5(*a*) shows the shape of $MoO_3$ powders serving as the source material, and FIG. 5(*b*) shows the shape of metal Mo powders acquired according to the present invention. FIG. 5(*c*) shows the shape of metal Mo powders acquired through a hydrogen reductions scheme by using the same source material, and FIG. 5(*d*) shows the shape of commercial Mo powders (Kojundo Chemical Laboratory Co., Ltd., Japan, 99.99% of purity).

As shown in FIG. 5(*a*), $MoO_3$ serving as a source material has an angled shape extending in a longitudinal direction, and the particle size of the $MoO_3$ is in the range of 10 μm to 30 μm.

Meanwhile, FIGS. 5(*c*) and 5(*d*) show the shape of the metal Mo powders, which are acquired through a hydrogen reduction scheme, and the shape of commercial Mo powders (Kojundo Chemical Laboratory Co., Ltd., Japan, 99.99% of purity) based on the same source material.

As shown in FIG. 5(*b*), the metal Mo powders according to the present invention have a spherical shape and the particle size in the range of about 1 μm to 3 μm, and the metal Mo powders have the shape of fine powders in the particle size of 5 μm or less, which is the object of the present invention. When comparing the metal Mo powders, which are acquired through the hydrogen reduction scheme shown in FIG. 5(*c*), with the commercial metal Mo powders shown in FIG. 5(*d*), the metal Mo powders acquired through the hydrogen reduction scheme are similar to the commercial Mo powders in the shape and the particle size.

As shown in FIGS. 5(*a*) to 5(*d*), all of the $MoO_3$ powders acquired through the thermal reduction scheme (see FIG. 5(*b*) of Ca according to the present invention and the $MoO_3$ powders acquired through the hydrogen reduction scheme (see FIG. 5(*c*)) have spherical shapes. Accordingly, as recognized from FIGS. 5(*a*) to 5(*d*), the metal Mo powders are formed according to a chemical vapor transport (CVT) mechanism of a shrinking core model.

In other words, differently from the flat-type crystal of $MoO_3$ serving as a source material, the Mo powders, which are produced from the reduction reaction, are grown by a min-core to represent a spherical shape.

In addition, it can be recognized that the particle size of the final powders is significantly reduced differently from the particle size of the source material.

In order to compare oxygen contents of powers shown in FIGS. 5(*a*) to 5(*d*) with each other, the oxygen content is measured by using a gas analyzer (LECO TCH-600) as described above.

Since the oxygen content in the metal powders exerts a significant influence on the characteristic of the related metal powders as described above, the adjustment of the oxygen content is preferable.

As the particle size of the metal powders is reduced, the reactive surface area is increased, and oxidization is sufficiently achieved by oxygen, so that the oxygen content is increased.

In order to compare the oxygen contents with each other, the oxygen contents are measured with respect to the $MoO_3$ serving as a source material, the metal Mo powders obtained by the production apparatus according to the present invention, the conventional metal Mo powders obtained through the hydrogen reduction scheme, and the commercial Mo powders.

In this case, remaining test samples other than the $MoO_3$ serving as the source material are prepared in the same particle size.

The measurement results of the oxygen contents are shown in Table 1.

TABLE 1

| Reduction Scheme | Particle Size of Powders | Oxygen Content | Remarks |
|---|---|---|---|
| Commercial Powders 1 | <150 μm | 3,600 ppm | Sigma Aldrich (99.99%) |
| Commercial Powders 2 | <5 μm | 4,800 ppm | Kojundo Chemical Laboratory Co., Ltd. (99.99%) |
| Hydrogen Reduction | <5 μm | 5,000 ppm | The same source material: LTS $MoO_3$ (99.95%) |
| Calcium Reduction | <5 μm | 2,800 ppm | |

According to the analysis of Table 1, the oxygen content in the powders (commercial powders 2), which are produced by Kojundo Chemical Laboratory Co., Ltd., Japan (purity of 99.99%) and sold as the commercial metal Mo powders, is about 4,800 ppm, and the oxygen content in the powders, which are produced by Sigma Aldrich, U.S. (purity of 99.95%) and sold as the commercial metal Mo powders (commercial powders 1), is about 3600 ppm. In other words, the oxygen content of 3,600 ppm or more is detected from both cases of the metal Mo powders which are commercially sold.

That is to say, in the case of the commercial metal Mo powders, the oxygen content of 3,600 ppm or more is detected.

Meanwhile, according to the present invention, the oxygen content in the metal Mo powders produced by using Ca and performing the second reduction step is about 2,800 ppm, which represents a remarkably low oxygen content as compared with that of the commercial powders.

On the contrary, the metal Mo powders, which are obtained through the hydrogen reduction scheme using the same source material as that of the calcium reduction scheme, are analyzed to have the oxygen content of about 5,000 ppm.

According to the analysis result, in the case of the metal Mo powders according to the present invention, which have been subject to the second reduction step using Ca, the oxygen content can be substantially reduced up to 2,000 ppm or more as compared with the conventional metal Mo powders obtained through the hydrogen reduction scheme.

It may be estimated that the above result is made because deoxidization is additionally performed in the second reduction step using Ca after performing a reduction reaction to the metal Mo powders from the $MoO_2$ by calcium vapor evaporated in the second reduction step using Ca.

In addition, according to the present invention, the metal Mo powders having the particle size of 5 μm or less, and the low oxygen content of 3000 ppm or less can be formed.

Although exemplary embodiments of the present invention have been described for the illustrative purpose, it is understood that the present invention should not be limited to these exemplary embodiments but various changes, modifications, equivalents can be made by one ordinary skilled in the art within the spirit and scope of the present invention as hereinafter claimed.

What is claimed is:

1. A method of producing molybdenum powders having a particle size of 5 μm or less and an oxygen content of 3000 ppm or less by reducing molybdenum trioxide, the method comprising:

charging a first reducing agent and the molybdenum trioxide on a micro-sieve, which is located on an upper portion of a bracket installed in a body, while the first reducing agent and the molybdenum trioxide are directly making contact with each other;

charging a second reducing agent in the bracket under the micro-sieve;

coupling the body with a cover to close the body; and performing a reduction reaction by raising an internal temperature of the body, wherein the first reducing agent and the second reducing agent comprise calcium powders, and the calcium powders constituting the first reducing agent have a particle size different from a particle size constituting the second reducing agent.

2. The method of claim 1, wherein the first reducing agent is charged in a content of 25 parts by weight to 75 parts by weight based on 100 parts by weight of molybdenum trioxide powders, and the second reducing agent is charged in a content of 200 parts by weight to 300 parts by weight based on 100 parts by weight of the molybdenum trioxide powders.

3. The method of claim 1, wherein the performing of the reduction reaction by raising the internal temperature of the body comprises:

performing a first reduction reaction due to direct contact between the first reducing agent and the molybdenum trioxide; and performing a second reduction reaction due to evaporation of the second reducing agent.

4. The method of claim 3, wherein the first reduction reaction is performed at a temperature in a range of 550° C. to 650° C., and the second reduction reaction is performed at a temperature in a range of 1000° C. to 1200° C.

5. The method of claim 4, wherein a time to raise a temperature to a reduction temperature for the first and second reduction reactions is in a range of 30 minutes to two hours, and a time to maintain the first and second reduction reactions is in a range of one hour to three hours.

* * * * *